United States Patent [19]

Brüssel

[11] Patent Number: 4,995,778

[45] Date of Patent: Feb. 26, 1991

[54] GRIPPING APPARATUS FOR TRANSPORTING A PANEL OF ADHESIVE MATERIAL

[75] Inventor: Richard Brüssel, Sulzfeld, Fed. Rep. of Germany

[73] Assignee: Krupp Maschinentechnik Gesellschaft mit beschränkter Haftung, Essen, Fed. Rep. of Germany

[21] Appl. No.: 460,282

[22] Filed: Dec. 29, 1989

[30] Foreign Application Priority Data

Jan. 7, 1989 [DE] Fed. Rep. of Germany ..... 3900342

[51] Int. Cl.[5] ..... B66C 19/00

[52] U.S. Cl. ..... 414/20; 414/753; 294/104

[58] Field of Search ..... 414/20, 75, 753, 793.5; 242/55.2; 221/25; 294/103.1, 104

[56] References Cited

U.S. PATENT DOCUMENTS 4,588,070 5/1986 Smith ..... 414/753 X
4,778,323 10/1989 Salts ..... 414/793.5 X
4,820,104 4/1989 Kwauka ..... 414/793.5 X

*Primary Examiner*—Robert P. Olszewski
*Assistant Examiner*—Donald W. Underwood
*Attorney, Agent, or Firm*—Spencer & Frank

[57] ABSTRACT

The present invention relates to a gripping apparatus for carrying along a adhesive panel of material and includes a carriage which is movably guided in the longitudinal direction of the panel and a holding tong disposed on the carriage with its long arms being configured to be adhesion reducing on their interior sides. To improve the economy and operational reliability of the gripping apparatus, it is proposed to equip the interior sides of the tong arms with a continuous adhesion reducing sheet which is pre-tensioned by means of a tensioning frame and to make the adhesion reducing sheet movable with a carriage. Displacement of the holding tongs, which is caused by the movement of the carriage results in a movement of the adhesion reducing sheet in the direction toward the front sections of the tong arms at the same velocity in opposite directions. Without the panel moving, the release movement of the holding tongs causes an adhesive panel of material disposed between the tong arms to be moved out of the tongs and to be released.

11 Claims, 4 Drawing Sheets

GRIPPING APPARATUS FOR TRANSPORTING A PANEL OF ADHESIVE MATERIAL

BACKGROUND OF THE INVENTION

The present invention relates to a gripping apparatus for longitudinally transporting a panel of adhesive material, the apparatus including a carriage movably guided in the longitudinal direction, and remote-controlled holding tongs disposed at the carriage, the tongs having arms with mutually facing interior sides which are configured to reduce adhesion.

Before panels of SMC (sheet molding compound) resin mat material, which is of particular interest here, are formed or worked into pressed objects, the covering sheets of release paper which usually protect the unworked SMC resin mat material, must be removed from the panels and (in the normal case) the panels are subdivided into rectangular mat strips from which mat packets are formed by placing several mat strips on top of one another. Mat strips of different widths may be produced as follows. If only a transverse cut of the panel is made, the width of the panel of material remains unchanged. However, if the panel is subdivided in both the longitudinal and transverse directions, mat strips are formed whose width is less than the width of the panel of material.

With a view toward better economy and less susceptibility to malfunction, the production of the mat strips should take place in such a manner that before the panel of material is subdivided in the transverse direction or in the longitudinal and transverse directions, the covering sheets should be removed. This avoids contact between the cutting mechanism and the covering sheets which are usually made of metal foil. After removal of the covering sheets, the further transport of the exposed panel of adhesive material into the region of the cutting apparatus and the subsequent depositing of the mat strip or strips on a transporting apparatus requires the use of at least one gripping apparatus which grips the end section of the panel of adhesive material, carries the material along and, after completion of the cutting process or processes, releases the panel of material.

SUMMARY OF THE INVENTION

It is therefore an object of the present invention to provide a gripping apparatus with which pulling forces can be exerted on panels of adhesive material and which makes it possible, with a long service life and low maintenance costs, to properly and accurately deposit the mat strips which are produced by the subdivision of the panel.

This is accomplished by a gripping apparatus for longitudinally transporting a panel of adhesive material in a first direction wherein a tensioning frame and a carriage are each movably mounted on a supporting frame. Upper and lower tong arms are mounted on the carriage, and a continuous adhesion reducing sheet is positioned, when viewed generally in the direction of panel travel, from the tensioning frame, along the interior of the upper tong arm, then around a direction-changing point, and thereafter in the reverse direction, i.e., opposite to the direction of panel travel, along the interior of the lower tong arm. The continuous sheet thereafter reverses direction again and extends along the underside of the lower tong arm, in the direction of panel travel, and is thereafter secured to the tensioning frame at a second point beyond the direction-changing point. Drive means are provided for tensioning the sheet, for closing the tong arms onto the mat strip, and for moving the carriage to transport the mat strip. Thereafter, the tong arms are released and the further movement of the carriage causes the continuous adhesion reducing sheet to release the mat strip.

Furthermore, one of the features of the invention is that the gripping apparatus, which has holding tongs including tong arms, includes a continuous adhesion reducing sheet which is driven or moved such that if the holding tongs are switched to be without power, then during the time interval when the mat strip which is disposed between the tong arms is stationary, the adhesion reducing sheet is pulled at the front edges of the tong arms, thus causing the adhesion reducing sheet to come loose from the adhesive mat strip. One of the holding tongs is attached to a carriage and during the adhesion sheet removal process, the holding tong attached to the carriage moves in the direction of longitudinal panel movement. During this time, the mat strip is removed from the adhesion removing sheet by an oppositely directed movement of the adhesion reducing sheet which contacts both sides of the adhesive panel.

Preferably the apparatus for implementing the objects of the present invention includes a carriage mounted to a supporting frame and movable in the longitudinal panel transport direction. The supporting frame is provided with a direction-changing point to support the adhesion reducing sheet. The end sections of the adhesion reducing sheet are fastened to opposed end sections of a tensioning frame which end sections lie one behind the other in the panel transporting direction. This tensioning frame is likewise arranged to be moveable relative to the supporting frame in the longitudinal panel transporting direction.

The direction changing point for the adhesion reducing sheet is stationary relative to the tensioning frame and the carriage and because the adhesion reducing sheet is wound around the direction changing point, the adhesion reducing sheet moves in the direction of the end sections of the tong arms along the mutually facing interior sides of the tong arms if the carriage is displaced in a direction opposite to the transporting direction of the panel of material.

The necessary pre-tensioning or bias of the adhesion reducing sheet is produced by a pre-tensioned spring element which engage the tensioning frame with a tensioning force active in the longitudinal panel transporting direction, the pre-tensioned spring element being simultaneously supported at the supporting frame. The holding tongs are equipped with a pair of tong arms, one tong arm being pivotally arranged at the carriage in such a manner that if the power is disconnected from the tong arm, then the tong arms take on a removal position which approximates their closed position. The movable arrangement of the tensioning frame relative to the supporting frame is achieved by providing supporting rollers on the supporting frame between which rollers the tensioning frame is held perpendicularly and transversely to the longitudinal extent of the panel of material. Thus the tensioning frame is movable back and forth only in the longitudinal panel transporting direction.

The carriage is movable relative to the supporting frame and the tensioning frame through the use of guide rollers such that the carriage is movable in the longitudinal panel transporting direction.

The holding tongs are preferably configured as a pair of pivotally connected tong arms, one to be placed over the panel of material and the other to be placed under the panel of material, and the tong arm which is to be placed over the panel of material is moved by a tong drive which is pivotally connected to the carriage. In one advantageous embodiment of the invention, the adhesion reducing sheet is fastened to the tensioning frame in such a manner that the sheet encloses the exposed end sections of the tong arms, i.e. those sections of the tong arms which face the panel of material.

When viewed in the longitudinal direction of panel movement, the end section of the sheet for the top tong arm is fastened in front of the end section of the sheet for the lower tong arm.

To improve the holding effect of the holding tongs, the interior of the end sections of the tong arms are provided with suitable recesses. To achieve these recesses the interior sides of the tong arms, inwardly of their respective end sections, are each provided with a sloped interior wall section.

In a preferred embodiment the spring element engaging the tensioning frame, the release drive engaging at the carriage and the tong drive engaging at the pivotal tong arm are each configured as cylindrical assemblies. In deviation from this embodiment, however, the spring element, in particular, may be composed of a mechanical spring having an adjustable tensioning force.

The supporting frame is connected to the carriage and can be pivoted about a horizontal axis to provide access to the region of the holding tongs for example in the case of a malfunction. By means of a clamping apparatus and an adjustment stop, the supporting frame can be fixed in different operating positions. Preferably, the carriage of this embodiment is equipped with a brake with which the supporting frame can be held in a pivoted position outside of its operating position. The brake ensures that the supporting frame does not move accidentally when it is not in its operating position.

BRIEF DESCRIPTION OF THE DRAWINGS

The various features, benefits and advantages of the present invention, together with other benefits and advantages which may be attained by its use, will become more apparent upon reading the following detailed description of the invention taken in conjunction with the drawings. In the drawings, wherein like reference numbers identify corresponding components.

DESCRIPTION OF THE PREFERRED EMBODIMENT

Figure 1:
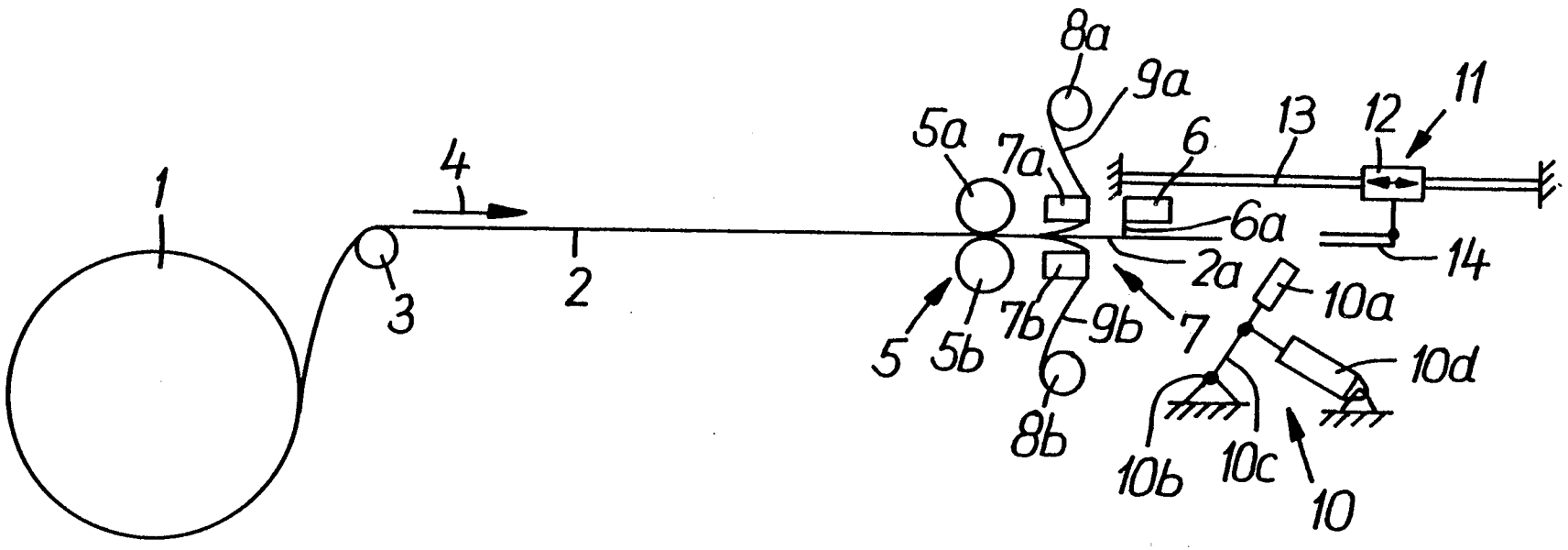
FIG. 1 is a highly schematic view of the structure of a mat strip producing system equipped, in the region of the transverse and longitudinal cutting apparatus, with the gripping apparatus of the present invention.

Referring first to FIG. 1, an SMC resin mat panel 2 is unwound from a coil 1 past a guide roller 3 in the direction of arrow 4 (i.e., to the right in FIG. 1) and is fed by a feed device 5 including a pair of opposed, spaced apart feed rollers 5*a*, 5*b* in the longitudinal direction to a cross-cutting device 6 for subdividing the adhesive resin mat panel in the transverse direction, i.e., transverse to the direction of longitudinal movement.

A clamping device 7, which is equipped with a pair of height adjustable clamping jaws 7*a*, 7*b*, is positioned longitudinally between the feed device 5 and the cross-cutting device 6. As is known, the SMC resin mat panel 2, which is in the form of a planar sheet having opposed surfaces, is protected by upper and lower cover sheets 9*a*, 9*b*, (which may be made of metal foil) while wound on the coil 1. A cover sheet removal device including upper and lower removal rollers 8*a*, 8*b*, respectively, is positioned longitudinally between the clamping device and the cross-cutting device. Upper removal roller 8*a* is vertically above upper clamping jaw 7*a*, and lower removal roller 8*b* is vertically below lower clamping jaw 7*b*. The cover sheet removal device serves to remove the upper cover sheet 9*a* and the lower cover sheet 9*b* toward the top and the bottom, respectively, with the clamping jaws which are open during the transporting movement of the resin mat panels 2 simultaneously serving as stripping blades.

During the cutting processes to be described below, the longitudinal transporting movement of the resin mat panels 2 (to the right in FIG. 1) is temporarily interrupted, at which time the clamping device 7 assumes the closed position in which clamping jaws 7*a* and 7*b* grip resin mat panels 2 and also covering sheets 9*a* and 9*b*.

The cross-cutting device 6 includes a cross-cut blade 6*a* followed, in the panel transporting direction (arrow 4 in FIG. 1), by a longitudinal cutting device 10. Depending on the desired number of mat strips to be produced, the cutting device 10 is equipped with one or a plurality of blades 10*a*.

Each blade is held at a pivot arm 10*c* so as to pivot about a stationary axis 10*b* disposed below the plane of the panel of material. This pivot arm 10*c* is movable back and forth by a pivot drive in the form of a cylinder assembly 10*d*. The longitudinal cutting device 10 is configured such that each blade 10*a* is able to perform a cut in the longitudinal direction of the resin mat panel, which cut is always directed opposite to the transporting direction in that the blade is pivoted from the bottom into the region of the resin mat panels 2. In the present case, a cutting movement is initiated by moving pivot arm 10*c* counterclockwise.

In the region of cutting devices 6 and 10, a gripping apparatus 11 is provided which can be moved by way of a carriage 12 along two stationary guide rails 13 perpendicularly to the plane of the drawing in the direction toward clamping device 7 such that the spaced holding tongs 14 of the gripping apparatus grip the end section 2*a* of resin mat panel 2 projecting to the right beyond clamping jaws 7*a*, 7*b*, hold it and carry it along in the transporting direction (arrow 4). This end section 2*a*, from which the cover sheets 9*a*, 9*b* have been removed, extends longitudinally into the effective range of cross-cutting blade 6*a*.

The holding tongs 14 can be opened and closed, and after closing the holding tongs 14 onto the panel, the clamping device 7 is released, wherein the resin mat panel 2 is carried along to the right by movement of carriage 12, with its covering sheets 9*a*, 9*b* being simultaneously removed. Additionally, longitudinal cutting device 10 is actuated by moving cylinder assembly 10*d* outwardly resulting in each blade 10*a* performing a cutting movement past the moving holding tongs 14, thus subdividing the resin mat panel longitudinally into several mat strips. As soon as the resin mat panel is longitudinally subdivided to correspond to the desired length of the mat strips, the movement of resin mat panel is interrupted by stopping carriage 12 and stopping feed device 5. Thereafter, by actuation of cross-cutting device 6, resin mat panel 2 is divided transversely to its longitudinal extent, severing the mat strips from the panel. Severing the mat strips from the panel also forms the freely projecting end section 2*a* for the next successive mat strips.

Immediately after completion of the cross-cutting process, carriage 12 and holding tongs 14 continue their longitudinal carrying movement until they reach the region of a transporting device (not shown) on which the resulting mat strips are deposited, thus forming mat stacks of such strips if desired. By means of the transporting device, the mat strips and the mat stacks formed therefrom may be transported to a press for further processing.

Figure 2:
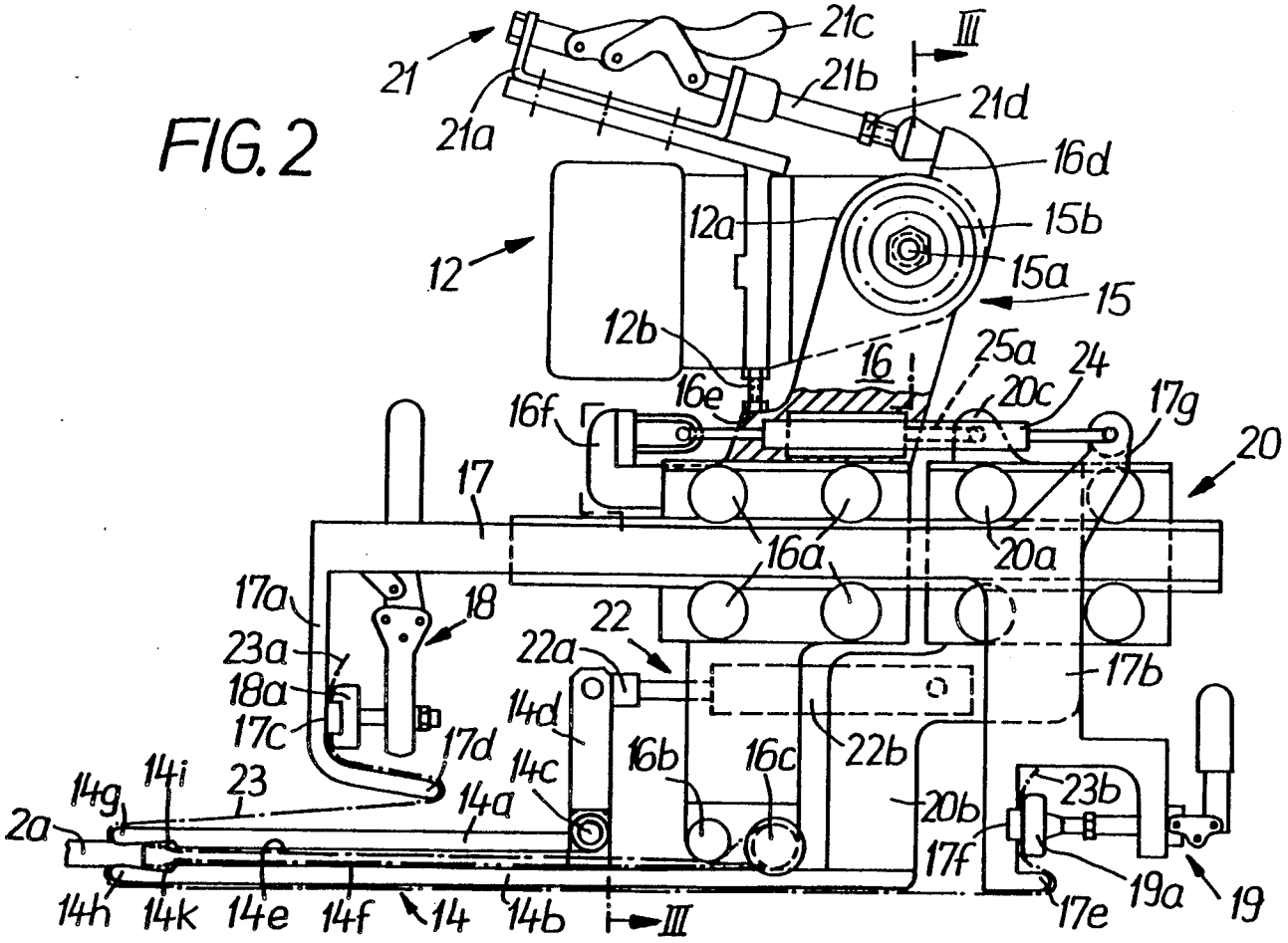
FIG. 2 is a schematic side view of a gripping apparatus of the present invention with the guide rail of FIG. 1 removed for clarity.

The gripping apparatus 11 will include one pair of holding tongs 14 for each of the mat strips severed from the panel. Thus if, for example, three cutting blades 10*a* are provided, to subdivide the panel into four mat strips, then four pair of holding tongs 14 will be provided. For clarity, the structure and operation of a gripping apparatus 11 whose carriage 12 is equipped with only one pair of holding tongs 14 will now be described with reference to FIGS. 2 to 4.

A supporting frame 16 is fastened to carriage 12 (shown without guide rails in FIG. 2) by an upper pivot bearing 15 having a horizontal axis of rotation 15*a* transverse to the longitudinal panel transport direction. Vertically below the pivot bearing, i.e., in a central section, supporting frame 16 is provided with four laterally projecting supporting rollers 16*a* and, at its lower section (i.e., vertically below the pivot bearing and the supporting rollers), the supporting frame is provided with a support roller 16*b* as well as a guide roller 16*c* disposed behind support roller 16*b* when seen in the direction in which the resin mat panels are transported (arrow 4 in FIG. 1).

The four supporting rollers 16*a* are arranged as an upper longitudinally spaced apart pair of rollers and a lower longitudinally spaced apart pair of rollers. A tensioning frame 17 is displaceably held between the upper and lower pairs of supporting rollers 16*a*. The tensioning frame 17 has a bent-away, L- shaped front section 17*a*, which opens rearwardly and terminates in an end 17*d*. The tensioning frame 17 also has a bent-away, L-shaped rear section 17*b* which opens rearwardly and terminates in an end 17*e*. The bent-away front section 17*a* and rear section 17*b* are each equipped with a clamping unit 18 and 19, respectively. Tensioning frame 17 simultaneously serves as guide path for a carriage 20 which carriage is equipped with four guide rollers 20*a*. The four guide rollers 20*a* are arranged in upper and lower longitudinally spaced apart pairs and tensioning frame 17 is held between the upper and lower pairs of guide rollers 20*a*.

The holding tong 14 includes an upper tong arm 14*a* and a lower or downwardly disposed tong arm 14*b*. The carriage 20 includes a downwardly oriented extension 20*b* which supports the downwardly disposed tong arm 14*b*. Tensioning frame 17 and carriage 20 together with holding tongs 14 are thus mounted relative to supporting frame 16 so that they are able to perform a longitudinal movement independently of the supporting frame 16 guided by support rollers 16*a* and by tensioning frame 17 as well as by guide rollers 20*a*.

Above the pivot bearing 15, supporting frame 16 is provided with an abutment face 16d which holds the supporting frame in its operating position by means of a fixing device 21. The fixing device is composed of a bracket 21a immovably connected to the carriage 12. A holding pin 21*b* is longitudinally displaceably guided in this bracket and holding pin is locked into position by a hinged lever 21*c*. The length of holding pin 21*b* can be changed by way of an adjustment nut 21*d*, and the change in length determines where the abutment face 16*d* will contact the end of the holding pin 21*b* relative to a vertical plane. This structure thus determines the position of the supporting frame 16 relative to a vertical plane.

The underside of carriage 12, i.e., the portion of the carriage facing the tensioning frame 17, is additionally equipped with an adjustment screw 12*b* which serves as a counter-abutment. Supporting frame 16 includes a second abutment face 16*e* disposed above the supporting rollers 16*a* for contact with the adjustment screw 12*b*. Thus supporting frame 16 may be positioned by holding pin 21*b*, abutment face 16*d* and counter-abutment 16*e* so as to be immovable in both directions of rotation.

As indicated previously, holding tongs 14 are composed of an upper tong arm 14*a* and a lower tong arm 14*b* whose rear section, which goes beyond the upper tong arm, is immovably fastened to the extension 20*b* of carriage 20. The tong arms are generally horizontally positioned and upper tong arm is pivotal about a shaft 14*c* carried by the lower tong arm and forming a pivot point and, in the region of this shaft 14*c*, the generally horizontal upper tong arm includes a vertical adjustment arm 14*d*. The tong drive generating the movement of the upper tong arm 14*a* is composed of a cylinder assembly 22 which includes a piston rod 22*a* moveable in a cylinder housing 22*b*. The piston rod is connected to adjustment arm 14*d* and the cylinder housing is connected to a vertically downwardly depending extension 20*b* of carriage 20. By moving out piston rod 22*a*, (i.e, by moving piston rod 22*a* in a direction opposite to the direction of panel movement) holding tongs 14 can be brought into the illustrated closed position.

The upper and lower tong arms have mutually opposed interior sides 14*e* and 14*f* respectively. To improve the operational capabilities of holding tongs 14, a continuous adhesion reducing sheet 23 which is provided with an adhesion reducing plastic coating such as polytetrafluoroethylene (Teflon) is provided on the interior tong arm sides.

The path traversed by the adhesion reducing sheet 23 will now be explained. Starting at a fastening point 17*c* formed between the front section 17*a* of the tensioning frame and clamping member 18*a* of clamping unit 18, adhesion reducing sheet 23 is supported, in succession, at a reversal face or end 17*d* of front section 17*a*, at a frontal end section 14*g* of the upper tong arm and at the supporting roller 16*b* of supporting arm 16, around the guide roller 16*c* into the region of the interior of the lower tong arm 14*b*, at a frontal end section 14*h* of the lower tong arm, below the lower tong arm and thereafter extending against a reversal face or end 17*e* of rear section 17*b*, to a second fastening location 17*f* where it is held between clamping member 19*a* of clamping unit 19 and a counterface of rear section 17*b*. In the illustrated embodiment, adhesion reducing sheet 23 is thus arranged in such a manner that the fastening point 17*c* for one end 23*a* of the sheet, which extends from the upper tong arm 14*a*, lies in front of the fastening point 17*f* for a second end section 23*b* of the sheet which extends beyond the lower tong arm to a rear section 17*b* of tensioning frame 17, when seen in the longitudinal panel transporting direction. Guide roller 16*c*, which is attached to support frame 16 and is stationary relative to tensioning frame 17 and carriage 20, thus functions as a direction-changing point for the sheet 23. Due to the displacement of tensioning frame 17 relative to supporting frame 16 in the direction of the longitudinal panel transporting movement (i.e. to the right in FIG. 2), adhesion reducing sheet 23 can be tensioned under the influence of guide roller 16*c*. This is accomplished by means of a spring element in the form of a cylinder assembly 24 which is articulated between a bracket 16*f* in the center region of supporting frame 16 and at an upwardly extending projection 17*g* on tensioning frame 17. In the operation of the gripping apparatus, the cylinder assembly 24 is continuously charged with pressure so that it acts as a compression spring by way of a projection 17*g* on the longitudinally movable tensioning frame 17, and the pretensioning force is absorbed by the adhesion reducing sheet 23 that is clamped in at both sides.

A removal drive in the form of a cylinder assembly 25, including a piston rod 25*a*, is further fastened to bracket 16*f*, with its piston rod 25*a* being articulated to a projection 20*c* which extends upwardly of carriage 20 above guide rollers 20*a*. Cylinder assemblies 24 and 25 are supported close to one another by bracket 16*f* (the positioning of the cylinder assemblies is illustrated in greater detail in FIG. 3) and cylinder assembly 25 has a larger effective diameter than cylinder assembly 24 although cylinder assembly 24 is equipped with the greater stroke length. By moving out cylinder assembly 25, i.e. displacing carriage 20 to the right in the longitudinal panel transporting direction, relative to frame 16, holding tongs 14 are likewise moved to the right (with no pressure on cylinder assembly 22 and with guide rollers 16*b* and 16*c* held stationary),the result is that adhesion reducing sheet 23 performs an oppositely directed movement in the interior between the two tong arms 14*a*, 14*b* at the same velocity and thus comes loose from the end section 2*a* of the resin mat panel which was initially held between the tong arms. In other words, upon the movement of cylinder assembly 25 as just described, the sheet sections lying against the resin mat panel are pulled along end sections 14*g* and 14*h* of the tong arms, this exposing the end 2*a* of the adhesive resin mat panel without movement of the adhesive resin mat panel.

To improve the transporting or carry-along effect of the tong arms, the interior of each tong arms is equipped, inwardly of end sections 14*g*, 14*h*, with recesses 14*i* and 14*k*, respectively, whose depth in the direction toward tong rotation axis 14*c* increases over a given length. With such a configuration, a certain form-lock is established between the adhesion reducing sheet, the tong arms and the gripped section of the adhesive resin mat panel.

Figure 3:
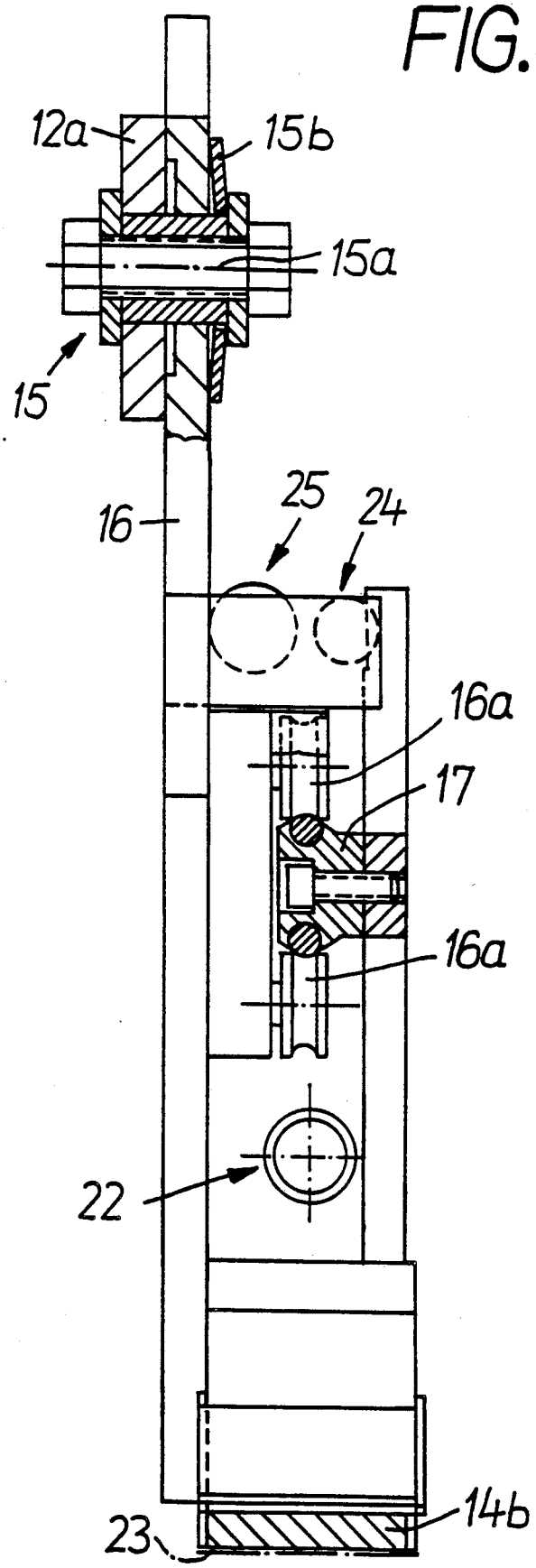
FIG. 3 is a sectional view seen along line III—III of FIG. 2.
Figure 4:
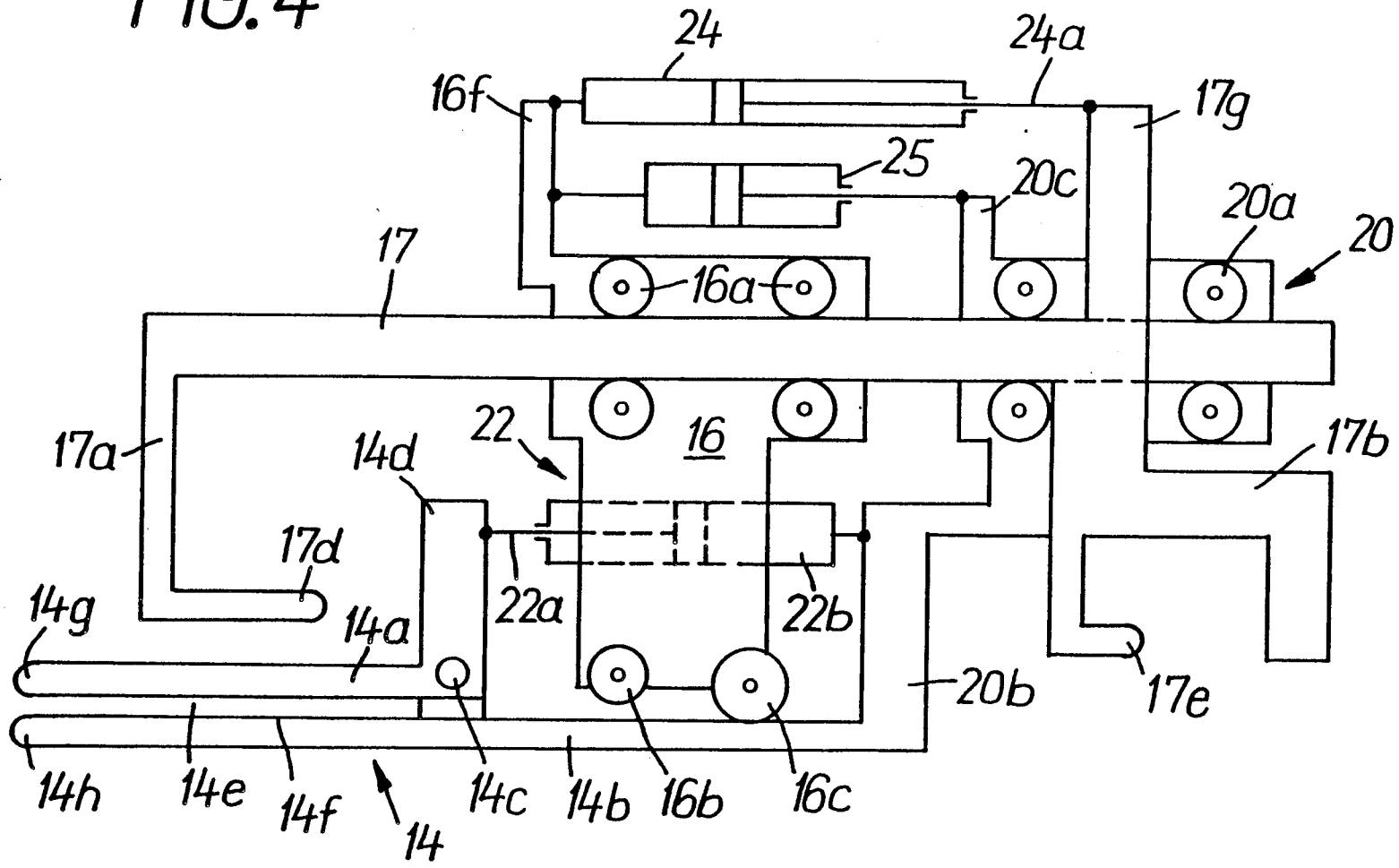
FIG. 4 is a schematic partial illustration of the arrangement particularly of the drive assemblies for the gripping apparatus of the present invention with the carriage and guide rails removed for clarity.

As illustrated in greater detail in FIG. 3, pivot bearing 15 is equipped with a brake in the form of a pretensioned cup spring 15*b* which presses supporting frame 16 against connecting face 12*a* of carriage 12 so that when the supporting frame 16 has been pivoted counterclockwise out of the operating position, will hold its once assumed pivoted position without the use of any further force. The counterclockwise pivoting of the frame 16 is achieved by raising hinged lever 21*c* which results in moving or returning holding pin 21*b* in the direction toward bracket 21*a*.

The gripping apparatus 11 of the present invention operates as follows. In order to grip the end section 2*a* of the resin mat panel which projects toward the right beyond clamping device 7, carriage 12 is moved to the left opposite to the panel transporting direction, with holding tongs 14 open, until the lower tong arm 14*b* lies below at least part of the end section. Then, the holding tongs are closed by actuating cylinder assembly 22 thus lowering the upper tong arm 14*a*. By moving carriage 12 to the right, the resin mat panel is carried along by way of its gripped end section 2*a*.

After the required cutting processes have been performed (dividing the resin mat panel in the transverse direction or in both the transverse and the longitudinal directions) carriage 12 is moved into a predetermined deposit position, with holding tongs 14 still remaining closed.

To release the mat strip that has been carried along, cylinder assembly 22 has its power switched off so that the upper tong arm 14*a* lies against end section 2*a* essentially under the load of only its weight. After the mentioned tong drive is shut off, cylinder assembly 25 is extended which moves or displaces carriage 20 to the right, i.e., in the longitudinal panel transporting direction. Since lower tong arm 14*b* is attached to the carriage 20 via projection 20*b*, as carriage 20 moves to the right the adhesion reducing sheet 23 performs the already described oppositely directed movement toward end sections 14*g*, 14*h* of the associated tong arms 14*a* and 14*b*, respectively, thus releasing sheet 23 from the stationary panel section 2*a*.

The advantage realized with the present invention is that it ensures problem-free removal of the adhesive resin mat panel by providing for a suitable release movement for the adhesion reducing sheet in the region of the holding tongs so that the adhesive resin mat panel can be removed without problems and can be deposited where intended.

The adhesion reducing sheet may of course also be attached in the region of the tong arms differently than described and illustrated. In the spirit of the proposed solution, it is important that the adhesion reducing sheet performs a peeling movement during the release process so that the adhesive resin mat panel is automatically transported out of the region of the tong arms without this requiring a transversely directed force on its surface.

If necessary, the gripping apparatus may also be equipped with a plurality of supporting frames, tensioning frames, carriages and holding tongs, etc. which are spaced from one another and held at a common carriage transversely to the longitudinal panel transporting direction. If thus, for example a panel of material is to be divided into two mat strips, a gripping apparatus equipped with two holding tongs will be employed.

The foregoing is a complete description of a preferred embodiment of the present invention. Numerous changes may be made without departing from the spirit and scope of the present invention. The invention, therefore, should be limited only by the following claims.

What is claimed is:

1. A gripping apparatus for longitudinally transporting a panel of adhesive material in a first direction comprising:

a supporting frame having a direction-changing point which is stationary relative thereto;

a carriage supported by said frame for movement in said first direction;

release drive means for moving the carriage in said first direction;

holding tongs separated by said carriage and including upper and lower tong arms having mutually facing interior sides;

the upper tong arm pivotally mounted relative to the lower tong arm;

a tensioning frame mounted to said carriage for movement therewith in said first direction;

a continuous adhesion reducing sheet having opposed first and second end sections each secured to said tensioning frame, said sheet traversing a continuous path from said tensioning frame along the interior side of the upper tong arm, around the direction-changing point and thereafter in a second direction opposite to said first direction along the interior side of the lower tong arm, and thereafter around the lower tong arm in said first direction to said tensioning frame; and a tong drive for pivotally moving said upper tong arm between a closed position, for gripping said panel with said tong arms as covered with said continuous adhesion reducing sheet, and a release position in which further movement of said carriage in said first direction releases said panel from said tong arms and said continuous adhesion reducing sheet.

2. A gripping apparatus for longitudinally transporting a panel of adhesive material in a first direction comprising:

a supporting frame having a direction-changing point which is stationary relative thereto;

a carriage supported by said frame for movement in said first direction;

a release drive means connected between the carriage and the supporting frame for moving the carriage in said first direction;

holding tongs including upper and lower tong arms having mutually facing interior sides which are configured to be adhesion reducing;

the upper tong arm connected to said lower tong arm at a hinge point, and the lower tong arm connected to said carriage at a point beyond said hinge point and beyond said direction-changing point when viewed in the first direction;

a tensioning frame mounted to said carriage for movement therewith in said first direction;

a pre-tensioned spring element connected between the tensioning frame and the supporting frame and exerting a force in said first direction;

a continuous adhesion reducing sheet having opposed first and second end sections; said sheet extending, when viewed in said first direction from the first end section which is secured to said tensioning frame, along the interior side of the upper tong arm, beyond the hinge point, around the direction-changing point and thereafter in a second direction opposite to said first direction along the interior side of the lower tong arm, and thereafter around the lower tong arm in said first direction beyond the direction-changing point to said second end section which is secured to said tensioning frame; and a tong drive for pivotally moving said upper tong arm between a closed position, for gripping said panel with said tong arms covered with said continuous adhesion reducing sheet, and a release position in which further movement of said carriage in said first direction releases said panel from said tong arms and from said continuous adhesion reducing sheet.

3. An apparatus as defined in claim 2, wherein the supporting frame is equipped with supporting rollers, and the tensioning frame is held by said supporting rollers only for longitudinal movement.

4. An apparatus as defined in claim 2, wherein the carriage includes guide rollers for supporting the tensioning frame for relative longitudinal movement therebetween.

5. An apparatus as defined in claim 2 wherein the tong drive is pivotally connected to the carriage.

6. An apparatus as defined in claim 2, wherein the upper and lower tong arms each include a front end section and wherein the adhesion reducing sheet encloses the front end sections of the tong arms.

7. An apparatus as defined in claim 2, wherein the first and second end sections of the adhesion reducing sheet are connected to the tensioning frame at first and second fastening points, respectively, the first fastening point being disposed in front of the second fastening point when viewed in said first direction.

8. An apparatus as defined in claim 2, wherein the front end sections of the tong arms are each provided with recesses at their interior sides for improving the holding effect.

9. An apparatus as defined in claim 2, wherein each of the spring element, the release drive and the tong drive are configured as cylinder assemblies.

10. An apparatus as defined in claim 2, and including a second carriage, the supporting frame being pivotally mounted to said second carriage about a horizontal axis, and an adjustable clamp means for holding the supporting frame in an adjustable operating position.

11. An apparatus as defined in claim 10, wherein the second carriage includes a brake for retaining the supporting frame in a non-operating pivoted position.

* * * * *